US010722903B2

(12) United States Patent
Zhang

(10) Patent No.: US 10,722,903 B2
(45) Date of Patent: Jul. 28, 2020

(54) TAILINGS RESOURCE RECOVERY PROCESS

(71) Applicant: BEI JING KE NENG MEI DA ER HUAN BAO KE JI CO., LTD, Beijing (CN)

(72) Inventor: Baoxiang Zhang, Shaanxi (CN)

(73) Assignee: BEI JING KE NENG MEI DA ER HUAN BAO KE JI CO., LTD., Beijing (CN)

( * ) Notice: Subject to any disclaimer, the term of this patent is extended or adjusted under 35 U.S.C. 154(b) by 253 days.

(21) Appl. No.: 15/576,429

(22) PCT Filed: May 28, 2015

(86) PCT No.: PCT/CN2015/080030
§ 371 (c)(1),
(2) Date: Nov. 22, 2017

(87) PCT Pub. No.: WO2016/187862
PCT Pub. Date: Dec. 1, 2016

(65) Prior Publication Data

US 2018/0154370 A1 Jun. 7, 2018

(51) Int. Cl.
*B03C 1/14* (2006.01)
*B03B 9/06* (2006.01)
(Continued)

(52) U.S. Cl.
CPC ..... *B03C 1/145* (2013.01); *B02C 23/12* (2013.01); *B02C 23/14* (2013.01); *B03B 9/06* (2013.01);
(Continued)

(58) Field of Classification Search
CPC ..... B02C 23/12; B02C 23/14; B02C 23/18; B02C 23/20; B02C 23/22; B02C 23/40;
(Continued)

(56) References Cited

U.S. PATENT DOCUMENTS 3,346,113 A * 10/1967 Lundmark ..... B03C 1/14 209/223.1
3,489,280 A * 1/1970 Merwin ..... B03C 1/14 209/223.1
(Continued)

FOREIGN PATENT DOCUMENTS

CN 101062502 A 10/2007
CN 101648162 A * 2/2010
(Continued)

OTHER PUBLICATIONS

English translate (CN101648162A), retrieved date Sep. 23, 2019.*
International Search Report for PCT Serial No. PCT/CN2015/080030 dated Jan. 18, 2016.

*Primary Examiner* — Adam J Eiseman
*Assistant Examiner* — Mohammed S. Alawadi
(74) *Attorney, Agent, or Firm* — Hamre, Schumann, Mueller & Larson, P.C.

(57) ABSTRACT

A tailings recovery process comprises: feeding ore pulp into a concentration barrel of a concentrating machine; driving the concentration barrel to rotate around its own central axis while the ore pulp flows, so as to enable the ore pulp to be continuously stirred and turn over in inner cavity of the concentration barrel; applying a magnetic field to the ore pulp by means of a magnetic field generation device; accurately sorting the ore pulp by means of a classifier, so as to enable selected minerals in the ore pulp to be exposed under the action of the magnetic field in processes of rising and dropping, thus attaching to an inner wall of the concentration barrel and moving upwards until reaching a collecting area; by making the selected minerals fall into a material receiving trough of the concentrating machine in the collecting area, enabling other materials in the ore pulp except the selected minerals to enter into a tailings trough of the concentrating machine at the bottom of the inner cavity of
(Continued)

the concentration barrel and then into a tailings conveying system.

7 Claims, 4 Drawing Sheets

(51) Int. Cl.
*B03C 1/12* (2006.01)
*B03C 1/30* (2006.01)
*B03C 1/033* (2006.01)
*B02C 23/12* (2006.01)
*B02C 23/14* (2006.01)

(52) U.S. Cl.
CPC ..... *B03C 1/0332* (2013.01); *B03C 1/12* (2013.01); *B03C 1/30* (2013.01); *B03C 2201/18* (2013.01)

(58) Field of Classification Search
CPC ..... B03C 1/0332; B03C 1/10; B03C 1/12; B03C 1/145; B03C 1/26; B03C 1/30; B03C 1/14; B03C 2201/18; B03C 1/247; B03B 9/06
USPC ..... 241/21
See application file for complete search history.

(56) References Cited

U.S. PATENT DOCUMENTS

| | | | | |
|---|---|---|---|---|
| 3,595,391 | A * | 7/1971 | Schmid | B03C 1/14 209/225 |
| 4,341,353 | A * | 7/1982 | Hamilton | B03B 9/06 241/19 |
| 6,383,397 | B1 * | 5/2002 | Kojima | B03C 1/03 210/695 |
| 9,375,727 | B2 * | 6/2016 | Molteni | F16C 33/4605 |
| 9,833,791 | B2 * | 12/2017 | Wang | B03C 1/14 |
| 2009/0071881 | A1 | 3/2009 | Smetannikov et al. | |
| 2012/0024762 | A1 * | 2/2012 | Zhang | B03C 1/12 209/214 |
| 2014/0231358 | A1 * | 8/2014 | Gokpekin | B03C 1/14 210/695 |

FOREIGN PATENT DOCUMENTS

| | | | |
|---|---|---|---|
| CN | 101890394 | A | 11/2010 |
| CN | 102527504 | A | 7/2012 |
| CN | 102631981 | A | 8/2012 |
| CN | 102974460 | A | 3/2013 |
| CN | 104607296 | A | 5/2015 |

* cited by examiner

TAILINGS RESOURCE RECOVERY PROCESS

CROSS-REFERENCE TO RELATED APPLICATION

This application is a National Stage application of International Patent Application No. PCT/CN2015/080030, filed on May 28, 2015, which is hereby incorporated by reference in its entirety.

FIELD OF THE DISCLOSURE

The present disclosure relates to environment renovation and resource recovery, and in particular, to a tailings resource recovery and environment renovation process.

BACKGROUND OF THE DISCLOSURE

As a mature industrial technology, ore sorting technology has existed for nearly 100 years. With the fact that the reserves of rich ore resources reduce gradually, however, the problem of serious waste of ore resources still occurs in the existing ore sorting technology and equipment.

In the current ore sorting industry, the equipment usually solely screens and purifies one mineral with a relatively high content, and discards other minerals, as a tailings waste, with relatively low contents, without purifying various metallic minerals in the tailings again, which causes wastage of a large amount of useful and valuable metallic minerals and thus causes pollutions to surroundings due to the stocking of the large amount of tailings.

In the respect of tailings processing, no effective resource renovation and resource recovery equipment has been proposed. Generally, the tailings refers to the waste discharged after the ore is ground and the useful components are extracted in an ore treatment plant under specific technical conditions, that is, the tailings refers to solid waste material after concentrates are sorted from ores. The tailings are main components in the industrial solid waste material which contains a certain amount of useful metallic and non-metal minerals. Taken as a mineral material such as a compound silicate, carbonate, or the like, the tailings have the characteristics of fine granularity, large quantities, and will induce pollutions and environmental hazard.

The tailings in China are mostly stored in a tailing dam by a natural bulk method. This kind of storage occupies much land and pollutes the mining area and its surroundings, causing potential safety hazards, also wastes a large amount of valuable metal and non-metal resources, so as to become a severe obstacle to mine development. Therefore, there is in urgent need of an effective disposal process to comprehensively utilize the tailings resource and reduce emissions, which could makes wastes profitable, thereby improving ecological environments, increasing resource utilization rate, and promoting the sustainable development of mining industries.

SUMMARY OF THE DISCLOSURE

In order to solve the above-mentioned problems, there is in urgent need of a method for increasing ore sorting efficiency and coping with the tailings. The inventor proposes a new ore sorting method and a complete tailings disposal process after many years of scientific experiments and research.

According to one aspect of the present disclosure, it proposes a tailings recovery process, including the following steps: enabling ore pulp formed by mixing mineral aggregate containing a first mineral with water to move inside a concentration barrel of a concentrating machine from entrance to exit thereof, wherein the central axis of the concentration barrel is arranged substantially horizontally; along with the moving of the ore pulp, driving the concentration barrel to rotate around its own central axis continuously so as to enable the ore pulp to move upward and drop repeatedly inside the concentration barrel, such that the ore pulp is continuously stirred and turn over in the inner cavity of the concentration barrel; applying a magnetic field to the ore pulp by a magnetic field generation device arranged along circumference of the concentration barrel, such that selected mineral particles in the pulp are attached to inner wall of the concentration barrel; accurately sorting the ore pulp through a classifier arranged at a predetermined distance from barrel wall of the concentration barrel in inner cavity of the concentration barrel, wherein the classifier substantially being parallel with the central axis of the concentration barrel, and the ore pulp turning over and being stirred in the inner cavity of the concentration barrel, along with the selected mineral aggregates, passing through a gap between an inner wall of the concentration barrel and the classifier; by the magnetic field on the circumference of the concentration barrel and the classifier, the selected minerals in the ore pulp are exposed under the action of the magnetic field in processes of rising and dropping, thus attaching to the inner wall of the concentration barrel and moving upwards with the rotation of the concentration barrel until reaching a collecting area located above in the inner cavity of the concentration barrel; enabling the selected minerals to fall into a first material receiving trough of the concentrating machine by a collecting mechanism in the collecting area, and leaving from the concentrating machine via the first material receiving trough; enabling other substances in the ore pulp except the selected minerals to enter into a tailings trough of the concentrating machine at the bottom of the inner cavity of the concentration barrel and then into a tailings conveying system.

With the method according to the present disclosure, valuable mineral aggregates can be effectively sorted from the large amount of various discarded ores or tailings.

The present disclosure has the following advantages: lower energy consumption; high metal recovery rate, achieving the recovered metal with high grade, and separating discharge of material flow from water flow, and could solving the problem of environmental pollutions fundamentally.

BRIEF DESCRIPTION OF THE DRAWINGS

In order to make clear the technical solution of the present disclosure, some embodiments of the present application will be described with reference to the attached drawings, wherein.

DETAILED DESCRIPTION OF THE EMBODIMENTS

Figure 1:
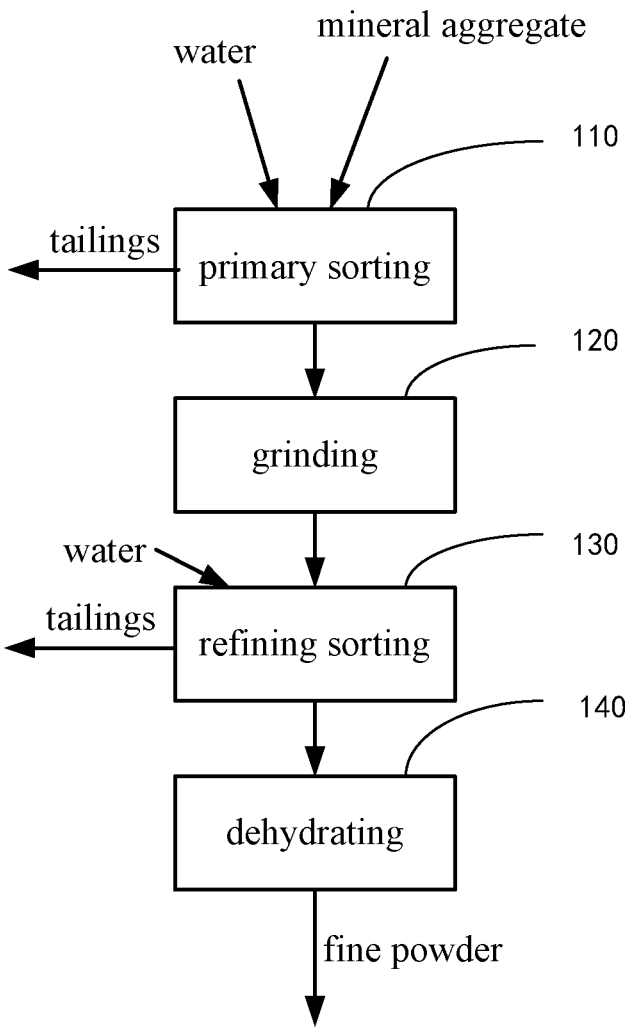
FIG. 1 shows a schematic flow chart of a tailings recovery process according to one embodiment of the present disclosure.

The present disclosure is further explained in combination with the accompanied drawings. The embodiments described in the present disclosure are merely a part of embodiments of the present disclosure, instead of all the embodiments. Based on the embodiments of the present disclosure, all other embodiments obtained by persons skilled in the art without paying creative work fall within the protection scope of the present disclosure. The protection scope of the present disclosure is not limited to the embodiments described hereinafter.

In the disclosed contents hereinafter, it is to be understood that the shown embodiments and examples are merely exemplary. Unless specially explained herein, the terms and expressions mentioned in the disclosed contents related to elements, components, equipment and processes have the definitions and meanings consistent with those commonly understood by persons skilled in the art. It should be noted that the shape, configuration and position of various equipment, devices, pipes, elements and assemblies shown in the drawings are merely schematic. It is to be understood that each element shown in the drawings may be in different forms as needed in practice, which does not depart from the spirit and gist of the present disclosure.

Hereinafter, the embodiments of the present disclosure will be described in conjunction with specific examples.

According to another aspect of the present disclosure, there is also provided a tailings recovery process used for extracting mineral compositions in the tailings.

As shown in FIG. 1, said tailings recovery process mainly includes primary sorting, grinding, refining sorting, dehydrating, or the like.

It is understood that the process and steps in the contents of the present disclosure can be not only used for processing tailings, but also for sorting magnetite, hematite and manganese ore, and performing ore sorting on nonferrous metal, rare metal, or the like. The ore obtained by using the tailings recovery process in the present disclosure includes, but not limited to, magnetite, hematite, veined tungsten mine, alluvial tin, beach placer, pyrrhotite, ilmenite, wolframite, tantalite, niobite, monazite, fergusonite, or the like.

In the following embodiment, referring to FIGS. 1 to 3, the tailings recovery process according to the present disclosure is specifically explained by taking the magnetite as an example. Mainly of a sedimentary-metamorphism type, the fine-disseminated magnetite is the major component as an iron mineral. The gangue mineral is mainly silicate minerals such as quartz or hornblende. In some cases, the gangue mineral has a high content of ferrosilite.

In the tailings recovery process according to the present embodiment, firstly, the tailings are primarily sorted. Usually, before entering in the primary sorting machine, the tailings need to be ground into particles. As shown in FIG. 1, the ore sorting process according to the present disclosure mainly includes primary sorting, grinding, refining sorting, dehydrating, or the like. In FIG. 1, the steps are denoted as steps 110, 120, 130 and 140.

[Primary Sorting]

The step 110 of primary sorting shown in FIG. 1 mainly includes the followings.

Feeding the granular tailings material and water into a primary sorting machine wherein the mineral aggregate and the water forming into ore pulp, while enabling the ore pulp move inside a roller, that is a primary sorting barrel, of the primary sorting machine from the entrance to the exit thereof, wherein the central axis of the primary sorting barrel is arranged in a horizontal direction.

The primary sorting barrel is driven to rotate around its own central axis, such that the ore pulp moves upwards from the bottom of the barrel along the inner wall of the primary sorting barrel and then drops due to the gravity while advancing, the primary sorting barrel continuously rotating, so as to enable the ore pulp to move upward and drop repeatedly in the rolling barrel.

A magnetic field is applied to the ore pulp in the inner cavity of the primary sorting barrel by a magnetic field distributed along the circumference of the primary sorting barrel, such that the selected minerals, that is a first mineral which is iron ore in the present embodiment, in the ore pulp attached onto the inner wall of the primary sorting barrel while the magnetic field is applied to the ore pulp so as to enable the selected minerals in the material to be stirred repeatedly under the action of the magnetic field in processes of rising and dropping inside the barrel, and to be combined one another during the stirring process to form a magnetic aggregate and/or a magnetic linkage.

After gathering into magnetic aggregates and/or magnetic linkages large enough, having enough sizes, the first mineral forming the magnetic aggregate and/or magnetic linkage attach to the inner wall of the primary sorting barrel and move upwards all the time with the rotation of the barrel, till arrive at the collecting area at the upper of the inner cavity of the primary sorting barrel.

By the collecting mechanism 39, the first mineral falls into a first material receiving trough 36 in the collecting area, and leaves from the primary sorting machine via an exit of the first material receiving trough 36.

The materials in the ore pulp except for the first minerals enter into a second material receiving trough via an exit of the primary sorting machine, and leave from the primary sorting machine via the second material receiving trough 36.

In the above-mentioned steps, the granularities of the ore particles entering into the primary sorting machine could be selected as needed. For example, in one embodiment, the granularity of the ore particles entering into the primary sorting machine ranges from about 60 to 120 meshes. The speed and flux of the mineral aggregate entering into the primary sorting machine could be determined according to on-site processing requirements.

For example, in the present embodiment, as for the magnetite, the feeding speed of the mineral aggregates entering into the primary sorting machine may be approximately 10-20 tons per hour. The design specification of the primary sorting machine can improve the throughout as needed, for example, 100 to 200 tons per hour.

In this process, the tailings can be fed into the primary sorting machine by a feeding machine, while the water, together with the mineral aggregates, is conveyed to the primary sorting machine, and the mineral aggregates are screened by the primary sorting machine.

In the primary sorting machine, by applying a circumferential magnetic field to the mineral aggregates, while enabling the mineral aggregates to be stirred and turn over in the roller of the primary sorting machine, the magnetic linkages and the magnetic aggregates are formed by using the mineral aggregates containing the magnetic minerals, and arrive at the upper cavity inside the roller with the rotation of the roller of the primary sorting machine, thereby the magnetic mineral aggregates being grabbed.

In order to obtain better ore sorting effects, the mineral aggregates can be further refining sorted, so as to further improve the grade of ore powder. Before the refining sorting, the mineral aggregates are ground again, such that the ore composition, for example, iron mine, in the mineral materials can be further separated from impurities.

[Ore Pulp Thickening]

Preferably, before the primarily sorted mineral aggregates are ground, the primarily sorted ore pulp may be conveyed into an ore pulp thickener. The primarily sorted ore pulp is thickened, to reduce water content, and increase pulp density, as the step 115 shown in FIG. 2.

In the process of thickening the ore pulp, the impurity with a specific gravity less than the effective mineral compositions could be discarded along with the water, so as to further increase the content of the mineral composition in the primarily sorted ore pulp.

Preferably, the water or waste material from the ore pulp thickener is conveyed to a dry discharger to be dehydrated, discharge waste residues and stock to a tailings ground.

The step of thickening of the ore pulp could be provided as needed. In the case that the ore pulp flowing out of the primary sorting machine satisfies the requirement of density, the process of thickening ore pulp could be omitted.

[Grinding Process]

Figure 2:
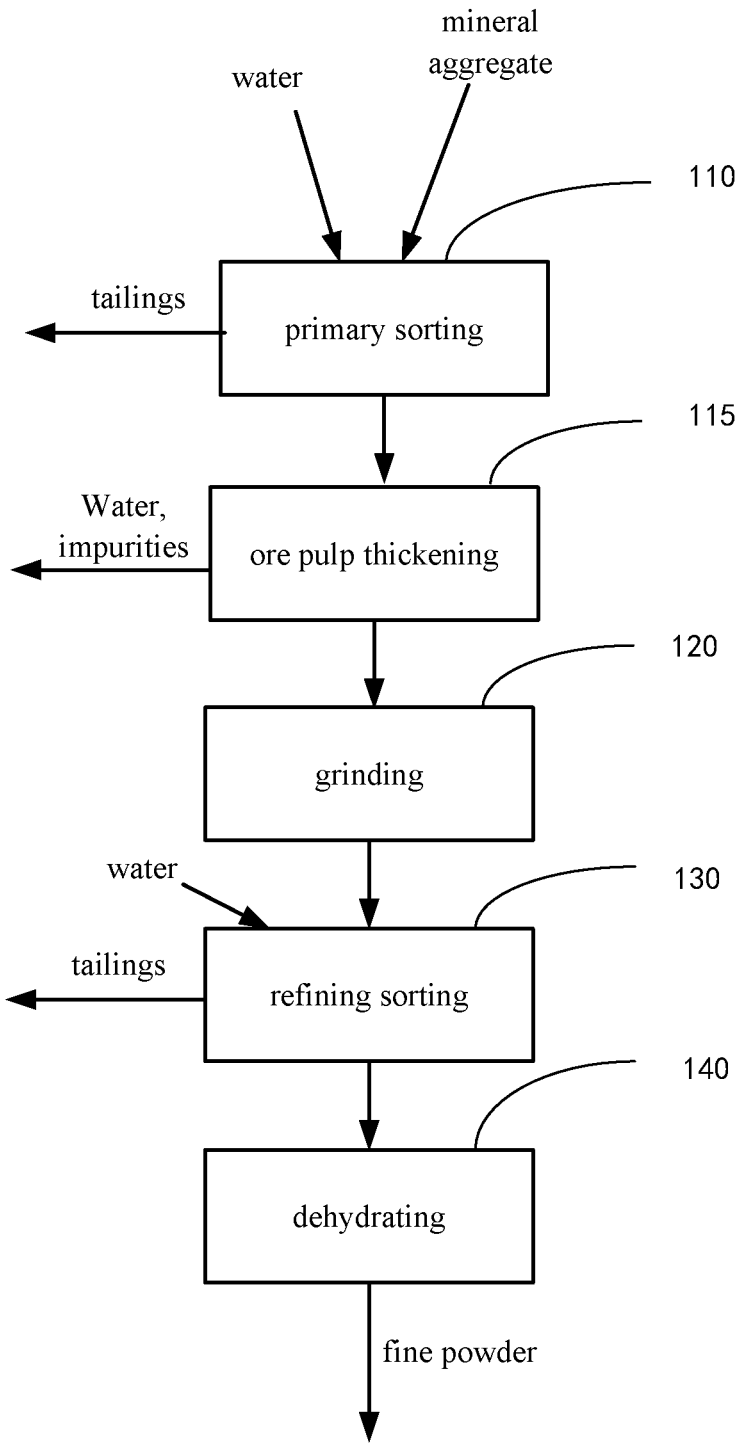
FIG. 2 shows a schematic flow chart of a tailings recovery process according to another embodiment of the present disclosure.
Figure 3:
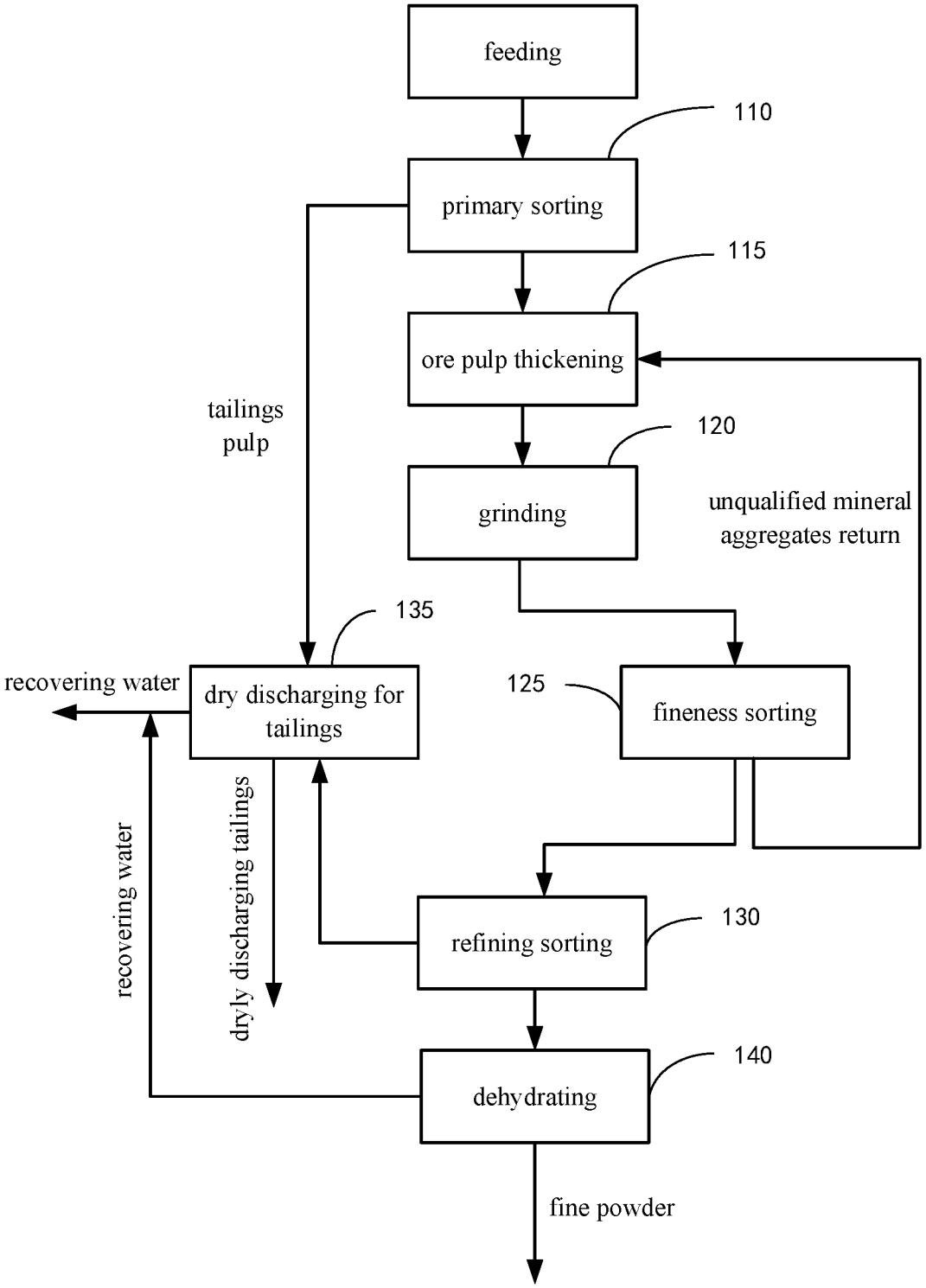
FIG. 3 shows a schematic flow chart of a tailings recovery process according to another embodiment of the present disclosure.

Since the mineral compositions are granularly disseminated in the ore, in order to obtain better sorting effects, before refining sorted, the mineral aggregates need to be ground again, as the step 120 shown in FIGS. 1 to 3.

The density and source of the ore pulp to be ground vary with the on-site requirement. In the case that the ore pulp is not thickened, the ore pulp screened by the primary sorting machine is fed into the grinder, to be further ground. If the step of thickening ore pulp is included in the tailings recovery process, the thickened ore pulp will be fed into the grinder.

During the step of grinding, the corresponding abrasive could be added if necessary. The mineral aggregates in the ore pulp are ground, to make the mineral aggregates into smaller particles, thereby further separating the magnetic materials from the non-magnetic materials in the ore pulp.

In one embodiment, the mineral aggregates are ground by a ball mill. Preferably, the ground mineral aggregates have a granularity ranging from 80 to 150 meshes.

[Fineness Sorting]

Preferably, in one embodiment, as the step 125 shown in FIG. 3, the fineness sorting may be performed on the ground ore pulp by arranging a fineness sorter. The ground ore pulp is conveyed to the fineness sorter to perform the fineness sorting, the mineral aggregates with unqualified fineness will be sent back to the grinder to be ground again, and the mineral aggregates with qualified fineness will be conveyed to the concentrating machine. For example, the mineral aggregates are conveyed to the concentrating machine in a form of ore pulp.

In the present embodiment, as for the magnetite, for example, the mineral aggregate particles coarser than 100 meshes could be sorted, and then the coarse mineral aggregates are conveyed back to the grinder to be ground again, until the mineral aggregates satisfy the requirements, and the qualified mineral aggregates are conveyed to the next process.

For the mineral aggregates, the mineral aggregates with unqualified fineness are usually the materials without realizing the separation of the magnetic materials from the non-magnetic materials, and need to return to the grinder to be ground again and separated, until the separation requirement is met. However, the specific granularity needs to be determined depend on the specific mineral composition.

For example, the primarily sorted magnetite has a granularity ranging from 60 to 120 meshes, and larger than 80 meshes in the refining sorting process. In other words, in the fineness sorting according to the present embodiment, the mineral aggregate particles with a granularity larger than 80 meshes will be baffled, and returned back to the grinder to be ground again. Preferably, the mineral aggregates with a granularity less than 90 meshes, more preferably, 120 meshes, will be baffled, and returned back to the grinder to be ground again.

[Refining Sorting]

In the concentrating machine, the ground mineral aggregates are refining sorted. Preferably, after the fineness sorting is performed on the mineral aggregates, the mineral aggregates with qualified granularity are refining sorted, as the step 140 shown in the drawings.

The refining sorting of the mineral aggregates may include the following steps:

Feeding the mineral aggregates, herein usually in the form of ore pulp, and water into a concentrating machine, and enabling the ore pulp formed therein by the mineral aggregate and the water to move inside a concentration barrel of the concentrating machine from the entrance to the exit thereof, wherein the central axis of the concentration barrel of the concentrating machine is arranged in a substantially horizontal direction.

Along with the moving of the ore pulp, driving the concentration barrel to rotate around its own central axis, such that the ore pulp moves upwards from the bottom of the barrel along the inner wall of the concentration barrel and then drops due to the gravity while advancing, the barrel body continuously rotating, so as to enable the ore pulp to rise and drop repeatedly in the concentration barrel, and to be stirred and turn over continuously in the inner cavity of the concentration barrel.

A magnetic field is applied to the ore pulp by a magnetic field generation device arranged along the circumference of the concentration barrel, such that the selected mineral particles in the ore pulp are attached onto the inner wall of the concentration barrel; preferably, the magnetic field is applied in a direction substantially perpendicular to the advancing direction of the pulp.

By applying the magnetic field, the selected minerals, herein the first mineral is iron ore in the present embodiment, in the ore pulp are stirred repeatedly under the action of the magnetic field inside the concentration barrel during rising and dropping, and the selected minerals are combined one another during the stirring process, to form magnetic aggregates and/or magnetic linkages.

After gathering into the magnetic aggregate and/or the magnetic linkages having enough size, the first mineral forming the magnetic aggregates and/or magnetic linkages attach to the inner wall of the concentration barrel and move upwards all the time with the rotation of the concentration barrel, till arrive at the upper collecting area.

Making the first mineral fall into a first material receiving trough in the collecting area of the concentrating machine by a collecting mechanism, and leave from the concentrating machine via the first material receiving trough.

Enabling the materials in the ore pulp except the selected minerals enter into a tailings trough of the concentrating machine at the bottom of the concentration barrel, and then into the tailings conveying system.

Preferably, in the above refining sorting process, the strength of the magnetic field applied in the concentration barrel is less than that in the primary sorting machine.

[Dehydrating]

The refining sorted mineral aggregates are fed into a dehydrator to separate the minerals from the water, as the step 140 shown in the drawings. The separated fine powder material could be conveyed to and stocked at a fine powder stock ground by a conveying device.

The ore pulp in the primary sorting machine and the concentrating machine, other than the selected minerals, both could be conveyed to the dry discharger for tailings to be dehydrated, as the step 135 shown in the drawings.

The process according to the present disclosure has been described in the above. Hereinafter, the improvements or modifications to the above process method will be described by explaining other embodiments.

In another aspect according to the present disclosure, there is provided a process method for mineral aggregates or for sorting mineral aggregates. Besides the new technical features described hereinafter, other steps of the process method are similar to those in the above-mentioned embodiments. For the sake of conciseness, the same or similar processes and steps are only stated simply or omitted, and are not described in detail herein.

Figure 4:
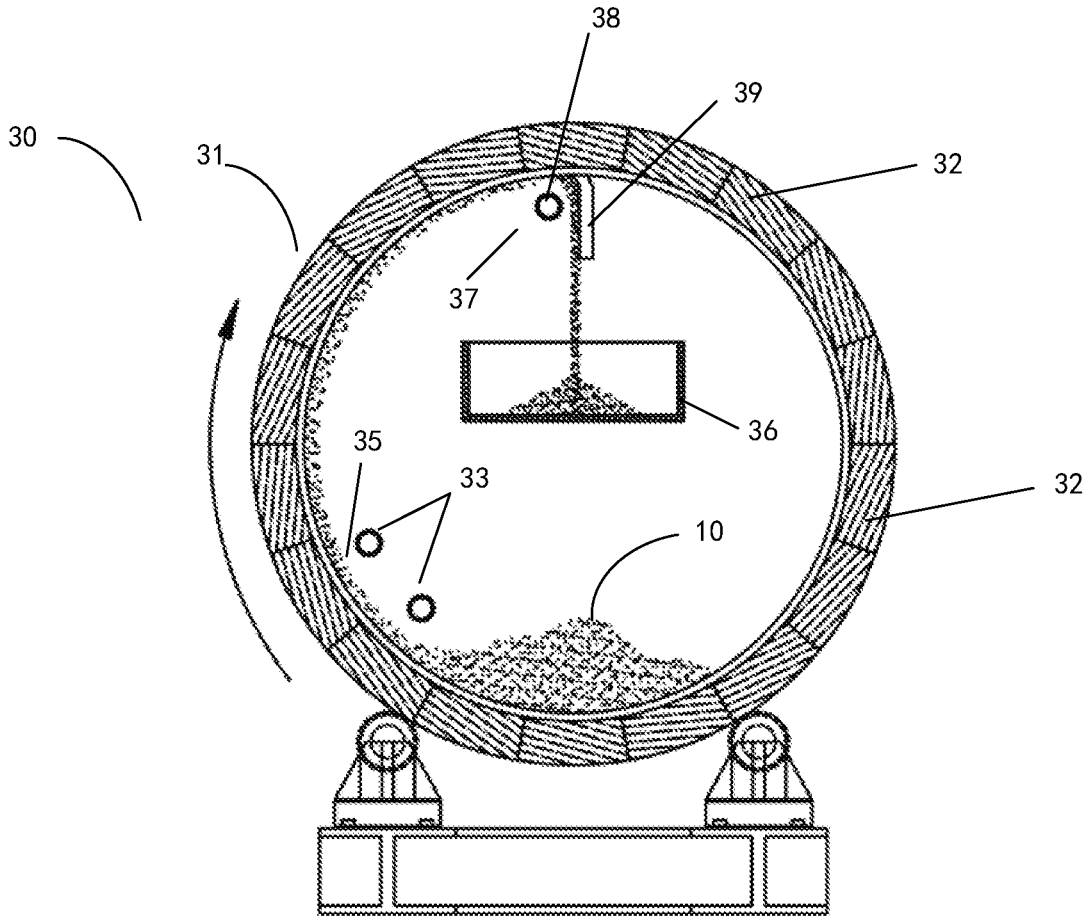
FIG. 4 shows a schematic diagram of a concentration barrel used in the tailings recovery process according to one embodiment of the present disclosure.

In another embodiment according to the present disclosure, there is provided a tailings resource recovery process which also includes the steps such as primary sorting, grinding, refining sorting, dehydrating, or the like, which in the present embodiment are the same as those described in the preceding embodiment, and will not be repeated hereinafter. Referring to FIG. 4, the following smart refining-sorting step in the present embodiment will be specifically explained below.

Similarly, the primarily sorted mineral aggregates are ground and then fed to the concentrating machine 30, or the sorted mineral aggregates are fed to the concentrating machine subsequent to the grinding and fineness sorting.

Enabling the ore pulp 10 formed by the mineral aggregate and the water move inside the concentration barrel of the concentrating machine from the entrance to the exit thereof, wherein the central axis of the concentration barrel is substantially horizontal.

Along with the moving of the ore pulp flows, the concentration barrel 31 is driven to rotate around its own central axis, such that the ore pulp moves upwards from the bottom of the barrel along the inner wall of the concentration barrel and then drops due to the gravity while advancing, the barrel body continuously rotating, so as to enable the ore pulp to rise and drop repeatedly in the concentration barrel, and to be stirred and turn over continuously in the inner cavity of the concentration barrel.

A magnetic field is applied to the ore pulp by a magnetic field generation device 32 arranged along the circumference of the concentration barrel, such that the selected mineral particles in the ore pulp are attached onto the inner wall of the concentration barrel; wherein a magnetic line of force of the magnetic field is substantially vertical to the advancing direction of the pulp.

The ore pulp is accurately sorted through a classifier 33 arranged at a predetermined distance from the barrel wall of the concentration barrel in the inner cavity of the concentration barrel; the classifier 33 substantially being parallel with the central axis of the concentration barrel 31, during the rotation of the concentration barrel, the ore pulp turning over and being stirred in the inner cavity of the concentration barrel, along with the selected mineral aggregates, passing through a gap 35 between the inner wall of the concentration barrel and the classifier; preferably, one or more classifiers 33 is arranged at a lower part of the inner cavity of the concentration barrel close to the barrel wall.

With the magnetic field applied on the circumference of the concentration barrel and the classifier, the selected minerals (the first mineral, which is iron mine in the present embodiment) in the ore pulp are exposed under the action of the magnetic field in processes of rising and dropping, and to be stirred repeatedly and combined one another during the stirring process, so as to form the magnetic aggregates and/or the magnetic linkages; after gathering into the magnetic aggregate and/or the magnetic linkage having enough size, the selected minerals attach to the inner wall of the concentration barrel and move upwards with the rotation of the concentration barrel until reaching a collecting area 37 located at the upper of the inner cavity of the concentration barrel.

Making the first minerals fall into a first material receiving trough 36 of the concentrating machine by a collecting mechanism 39 in the collecting area 37, and leave from the concentrating machine via the first material receiving trough 36.

Enabling the materials in the ore pulp except for the selected minerals enter into a tailings trough of the concentrating machine at the bottom of the inner cavity of the concentration barrel and then into a tailings conveying system.

Preferably, as shown in FIG. 4, a classifier 38 parallel with the central axis of the concentration barrel is also arranged at the upstream of the collecting mechanism 39 of the collecting area 37, such that the selected mineral aggregates pass through the gap between the inner wall of the concentration barrel and the classifier 38, and arrive at the collecting area 37 to be collected. This classifier 38 is substantially parallel with the central axis of the concentration barrel.

Preferably, the classifier is made of a magnetic conductive material such as iron. For example, the classifier may be a metal bar made of iron, or the like. Preferably, the classifier may be a hollow metal tube used for supplying water at the same time.

In the embodiment shown in FIG. 4, each of the classifiers does not rotate with the concentration barrel, for example, it can be fixed on a bracket outside the concentration barrel. However, it is understood that the classifier could be movable during ore sorting, for example, rotatable with the concentration barrel. A plurality of classifiers could be arranged as needed along the inner wall of the concentration barrel at intervals, and also could be fixed on the bracket outside a sorting barrel, or be fixed on the sorting barrel following with the rotation of the sorting barrel.

The refining sorted ore pulp is divided into two parts. The selected mineral aggregates, that is, the fine powder mineral aggregates, are sent to the fine powder stock ground to be stocked after dehydration.

The screened tailings enter in the dry discharger for tailings to be dehydrated, and then stocked to the tailings ground.

In the tailings recovery process according to the present disclosure, preferably, the strength of the magnetic field of the ore pulp in the concentrating machine is less than that in the primary sorting machine. In the concentrating machine, the magnetic mineral or the magnetic inductive mineral is grabbed, thereby obtaining the refining sorted mineral aggregates; the nonmagnetic materials is discarded with the waste residue entering in the dry discharger for tailings to be dehydrated, with the dry waste residue discharged, to be stocked to the tailings stock ground.

In the concentrating machine, the concentrating machine applies a circumferential magnetic field on the mineral aggregates, and at the same time the mineral aggregates are stirred and turn over in the roller of the concentrating machine. The mineral aggregates containing the magnetic minerals as thus form the magnetic linkages and the magnetic aggregates, and arrive at the upper of the roller with the rotation of the roller of the concentrating machine, thereby grabbing the magnetic mineral aggregates. The grabbed mineral aggregates enter into the first material receiving trough at the upper of the roller, and the un-grabbed non-magnetic materials flow out from an exit end of the concentrating machine via the tailings trough.

In the above-mentioned refining sorting process, the ore pulp could be ground by a ball mill, and then be fed into the fineness sorter. The qualified ore pulp with a predetermined fineness specification is discharged, and then goes to the next stage to be subjected to the refining sorting job; and the ore pulp without passing through the fineness sorter returns into the ball mill again to be ground secondarily. This process successfully solves the obstacle during the magnetic aggregation of the magnetic ores due to the fact that the magnetic ores cannot be separated from gangue and non-magnetic substance covered and wrapped thereon, and eliminates the waste of the magnetic ore by mistake. By this process, the magnetic aggregation phenomenon could rapidly occur in the ore pulp fed into in the concentrating machine, and thus the ore pulp form the "magnetic aggregate" or the "magnetic linkage" under the action of the magnetic force and turns over when moving to a magnetic pole. Due to a change in the strength value of the magnetic field, the moving direction of the magnetic line of force also changes. When turning over in a rotating direction of the barrel, the "magnetic aggregate" or the "magnetic linkage" drives the ore pulp to turn over multi-directionally and irregularly, so the magnetic substance has the magnetic aggregation phenomenon more effectively.

Preferably, as shown in FIG. 3, the tailings recovery process according to the present disclosure includes the processes of primary sorting, thickening, grinding, fineness sorting, refining sorting and dehydrating, or the like.

[Ore Pulp Density and Abrasive Granularity]

The ore pulp density and the abrasive granularity have a certain influence on the ore sorting process.

As for the ore pulp density, it needs to select and set an appropriate ore pulp density. The excessive high ore pulp density may cause excessive high sorting density, thereby deteriorating the concentrate quality. At this point, the concentrate particles tend to be covered and wrapped by finer gangue particles, and thus cannot be separated, which reduces the grade. The excessive low ore pulp density would greatly increase the ore grinding cost, reduce the ore-drawing rate, and restrain the grinding process. In addition, the too much low ore pulp density also causes lower sorting density, and bring the fact that the flow velocity increases, and shortens the sorting time. In this way, some magnetic particles will be missed due to the increased flow velocity, which should be caught under normal velocity. Therefore, according to different equipment parameters and ore types, it is also one of the key factors for obtaining good ore sorting effects to set the corresponding ore pulp density.

Preferably, after the primary sorting, the selected first mineral is conveyed to the next process in the form of ore pulp. Before grinding, the ore pulp needs to be thickened, so as to improve the grinding efficiency. Before the refining sorting process, in order to achieve good ore sorting effects, it needs to add water in the concentrating machine to dilute the ore pulp.

For example, the grabbed useful ore pulp flows into the ore pulp thickener, and then a large amount of clear water is added in the refining sorting process, so as to reduce the density of the ore pulp.

For example, in one embodiment according to the present disclosure, before grinding, the thickened ore pulp has a density ranging from 30% to 35%.

In another embodiment, the ore pulp entering into the concentrating machine has a density ranging from 25% to 35% (a weight percentage of mineral aggregates in the ore pulp), and then clear water is added again. After sorting, the ore pulp in the first material receiving trough of the concentrating machine has a density ranging from 30% to 40%. At the same time, the ore pulp entering in the tailings trough has a density ranging from 10% to 60%.

As for granularities of the mineral aggregates, it is also a very important factor in process. During the magnetic sorting process in the present disclosure, a classification is performed on different mineral compositions by the steps such as primary sorting, grinding, fineness sorting, refining sorting, or the like, so as to achieve good ore sorting effects.

The applicant obtains a set of granularity parameters through his research. These parameters are applicable to the above-mentioned tailings recovery process in the present disclosure, so as to obtain good ore sorting effects.

For example, in the ore sorting process for the magnetite according to the present disclosure, the granularity in primary sorting may range from 60 to 120 meshes, and needs to be greater than 80 meshes in refining sorting. In other words, in the fineness sorting according to the present embodiment, the ore particles with granularity larger than 80 meshes will baffled, and returned to an abrasive machine to be ground again. Preferably, the ore particles with granularity less than 90, preferably, 120 are picked out, and returned to the abrasive machine to be ground again.

It is understood that the ore pulp density and the granularity of mineral aggregates required during the ore sorting process should be determined depends on the types of mineral and the equipment specification and accuracy. In one embodiment, the grinding equipment could be a ball mill. The mineral aggregate ground by the ball mill may have fineness up to 200 meshes. For some nonferrous metal minerals, the ore particles fed into the concentrating machine or the primary sorting machine could have fineness even up to 300 meshes.

In the tailings recovery process according to the present disclosure, when the magnetite is sorted, the mineral aggregate entering in the primary sorting machine or the concentrating machine should have fineness less than 80 meshes.

On the other hand, in the tailings recovery process according to the present disclosure, the particles of the mineral aggregates are not the finer the better. As for the mineral aggregate with iron ore wrapping impurities therein, too small granularity is not suitable. For the iron ore, preferably, the ore particle entering into the concentrating machine has a granularity ranging from 80 to 200 meshes, more preferably, between 80 and 120 meshes.

The mesh number mentioned herein is used for defining the granularity or degree of thickness of materials, usually, referring to the hole number of a screen cloth within 1 square inch. It means that the greater the mesh number, the smaller the granularity of the material, and the less the mesh number, the larger the granularity of the material. A sieve size refers to a size of a sieve pore of a screen cloth through which the particles may pass, and is denoted by the number of sieve pores in the screen cloth with 1 inch (25.4 mm), thus referred to as the mesh number. The mesh number mentioned herein is in accord with the standard regarding the mesh number in the engineering technical field of China (referring to a Tyler standard screen of US). For example, the mesh number mentioned herein has a corresponding relationship with the granular size as follows:

80 meshes=0.180 mm; 120 meshes=1.125 mm; 200 meshes=0.075 mm.

Additionally, the appropriate feeding speed needs to be selected as needed. In the method according to the present disclosure, the required feeding speed may be set as necessary. For example, the feeding speed may be 20 Ton/hour, and may be up to 100-200 Ton/hour maximally.

In the primary sorting machine and the concentrating machine according to the present disclosure, the primary sorting barrel and the concentration barrel are both made of a wear resistant material which the magnetic field could penetrate through but has no influence on the magnetic field, for example, stainless steel or wear-resistant rigid plastic material, or other suitable materials.

In the above-mentioned tailings recovery process according to the present disclosure, it is possible to sort different mineral compositions from the mineral aggregates separately. For example, it is possible to sort the mineral compositions with different magnetic properties, or to sort the material with relatively strong magnetic property or relatively strong induced magnetism in a compound (by the primary sorting machine or the concentrating machine).

In the tailings recovery process according to the present disclosure, depends on the specific mineral composition to be sorted, the position and length of the classifier located in the sorting machine (the concentrating machine in the present embodiment) may be adjusted. In other words, the position of the classifier is adjustable. The change in position of the classifier includes: a change in vertical height, a change in horizontal direction, and a change in a distance from the barrel wall of the sorting barrel (concentration barrel). In the case that the classifier is movable, the position of the classifier relative to the barrel wall is fixed, but may be adjusted according to different mineral compositions and sorting requirements. Subsequent to the adjustment of the position of the classifier, the classifier needs to be fastened at new position.

In the tailings recovery process according to the present disclosure, the position of the classifier in the sorting barrel is determined according to the mineral composition to be sorted and the type of raw material. In the case that the raw material or the sorted mineral in the ore sorter does not change, the position of the classifier need not to be adjusted or changed any more. Of course, in order to change the type, grade and parameter of the sorted mineral, the position of the classifier may be adjusted again according to the type of the minerals.

Preferably, the length of the metal is substantially the same as the length of the magnetic field of the sorting barrel.

Preferably, each of the action areas of the magnetic field in the primary sorting machine and the concentrating machine is greater than 6 square meters.

In one embodiment of the method according to the present disclosure, classifiers could be also arranged in the primary sorting machine.

Preferably, in the tailings recovery process according to the present disclosure, the strength of the magnetic field in a circumferential direction of the primary sorting barrel in the primary sorting machine is between about 3000 gs (gauss) to 6000 gs. The strength of the magnetic field in the concentrating machine is between 0 and 2000 gs.

Of course, the strength of the magnetic field in the ore sorting machine (primary sorting machine and concentrating machine) could be determined as needed. In the case that the magnetic field is generated by using the electromagnetic device, the strength of the magnetic field in the primary sorting machine may high up to 20000 gs.

In the method according to the present disclosure, two groups of permanent magnet plates disposed in the circumferential direction of the barrel body may be used, thereby generating the magnetic field in the circumferential direction of the concentration barrel or the primary sorting barrel, wherein each group of the magnetic plates includes two magnetic plates having opposite magnetic polarity, wherein N poles and S poles are arranged alternately. The magnetic plate may be made of permanent magnet. In other embodiments, more groups of magnetic plates may be arranged on the barrel body, for example, 3 to 10 groups of magnetic plates. It is understood that according to the size of the barrel body, an appropriate number of magnetic plates may be arranged on the primary sorting machine or the concentrating machine, so as to generate the magnetic field in the circumference of the barrel body of the ore sorting machine. The magnetic plate may also be an electromagnetic device.

Preferably, in the primary sorting machine and the concentrating machine, one strong circlewise magnetic field could be arranged at one end of the primary sorting barrel and/or the concentrating machine which close to the exit, for preventing the magnetic substance from flowing out of the primary sorting barrel or the concentration barrel. The strength of the magnetic field is preferably larger than 4000 gs.

The primary sorting barrel and the concentration barrel have a revolving speed of 5-20 r/min, preferably, 8-15 r/min. It is understood that the primary sorting barrel or the concentration barrel may have other appropriate revolving speeds.

In the tailings recovery process according to the present disclosure, when the mineral aggregates rotate within the sorting barrel (the primary sorting barrel or the concentration barrel), the strength of the magnetic field acting on the mineral aggregates may change unevenly from 0 to 5000 GS at interval. With the different arrangements of the magnetic plates, the magnetic line of force at the periphery of the sorting barrel changes both horizontally and longitudinally.

ADVANTAGEOUS EFFECTS

With the tailings recovery process according to the present disclosure, at least the following advantageous effects may be achieved.

It is possible to sort metallic iron from sulphuric acid cinder, and to obtain the metallic iron having up to Tfe 85% therefrom, much higher than the maximum rate of 63.3% in the state-of-the-art tailings recovery process in China.

The iron fine powder may be further purified by this way. For the iron fine powder about 65% content, by using the tailings recovery process according to the present disclosure, the content of the produced iron fine powder may be up to 71.5%, almost close to 72.4% which is a theoretical value of ferroferric oxide.

Hereinafter, the advantageous effects and the great economic benefits generated and brought by the tailings recovery process according to the present disclosure will be explained in detail in way of some examples.

Example 1

By using the method according to the present disclosure, tailing sand of ultralow-grade vanadium titano-magnetite of ultabasic rock from someplace of Hebei province in China is sorted.

According to the test report from one chinese testing authority, the original mineral content in the above-mentioned tailing sand is as follows (in total 100%): 47.59% pyroxene mineral, 18.53% amphibole mineral, 14.51% feldspar mineral, 5.87% ilmenite mineral, 5.19% montmorillonite, 1.75% chlorite mineral, and 6.55% illite mineral. It can be seen that no monomineral of the magnetite is contained in the tailing sand.

In the tailings processing process in the prior art, it is hardly to sort the iron fine powder meeting the industrial standard requirement from the above-mentioned tailing sand of ultralow-grade vanadium titano-magnetite. Since based on common mineralogy, crystal chemistry theory and ore sorting experience in the prior art, although the pyroxene and the amphibole include iron, they are "lattice iron" in the silicate, and has not been be sorted by a physical ore sorting method. The ilmenite indeed includes iron, but Fe in feTiO3 is only 36.8%, Ti is 36.6%, and oxygen is 26.6%. For the tailing sand with only 5.87% ilenite, it is theoretically impossible to sort the iron fine powder meeting the industrial requirement.

However, by using the tailings recovery process according to the present disclosure, the test report from the authority shows that in the first ore sorting test using the above-mentioned tailings recovery process according to the present disclosure, the iron fine powder Tfe obtained by refining sorting the tailings is up to 57.55%.

In the second test, the sorted iron fine powder Tfe is 65.78%.

Example 2

32 tons of tailings are sampled from a certain mine field for the ore sorting test.

With the tailings recovery process according to the present disclosure, the ore sorting test (the tailing sand of the same mine industrial type) achieves the following result.

Tfe has a content of 8.52%, the sorted fine powder has a grade of 65.67%, the tailing Tfe has a grade of 3.61%, the recovery rate of the metal subjected to ore sorting is 60.98%, and the productive rate is 7.9%.

As compared, for the same type of tailing sand, the best index obtained by the tailings recovery process in the prior art is as follows.

The tailing sand Tfe has a grade of 7.91%, the fine powder also has a grade of 65.76%, but the recovery rate of the metal subjected to ore sorting is 21.23%, and the productive rate is 2.46%.

It can be seen that the recovery rate of the metal subjected to ore sorting obtained by the tailings recovery process according to the present disclosure is higher than the best index of 21.23% by 39.75%, and the productive rate is higher than the current best index of 2.46% in China by 5.44%. This means that the Tfe has the same content substantially as the same tailing sand, and the sorted iron fine powder has a grade of 65.67%. However, for the ore sorting technology of the present disclosure, each time 100 tons of tailing sand is processed, extra 5.44 tons of iron fine powder is produced, additional five thousand RMB of income is obtained, and extra 39.75% of metal is recovered, compared with the prior art.

As such, the ore sorting technology according to the present disclosure has very good technical effects.

The foregoing is merely the preferable embodiments of the present disclosure, but the protection scope of the present disclosure is not limited thereto. Any change or substitution conceivable by persons skilled in the art within the technical range disclosed by the present disclosure shall fall within the protection scope of the present disclosure. Therefore, the protection scope of the present disclosure shall be defined by that of the claims.

What is claimed is:

1. A tailings recovery process, comprising:

enabling ore pulp formed by mixing mineral aggregate containing a first mineral with water to move inside a concentration barrel of a concentrating machine from entrance to exit thereof, wherein the central axis of the concentration barrel is arranged horizontally;

along with the moving of the ore pulp, driving the concentration barrel to rotate around its own central axis continuously so as to enable the ore pulp to move upward and drop repeatedly inside the concentration barrel, such that the ore pulp is continuously stirred and turn over in an inner cavity of the concentration barrel;

applying a magnetic field to the ore pulp by a magnetic field generation device which is affixed to the concentration barrel and extends along an entire circumference of the concentration barrel, such that selected mineral particles in the pulp are attached to inner wall of the concentration barrel;

sorting the ore pulp through a classifier arranged at a predetermined distance from a barrel wall of the concentration barrel in the inner cavity of the concentration barrel, the classifier substantially being parallel with the central axis of the concentration barrel, and the ore pulp turning over and being stirred in the inner cavity of the concentration barrel, along with the selected mineral aggregates, passing through a gap between an inner wall of the concentration barrel and the classifier;

exposing, by the magnetic field generation device extending along the entire circumference of the concentration barrel and the classifier, the selected minerals in the ore pulp under the action of the magnetic field in processes of rising and dropping, thus attaching to the inner wall of the concentration barrel and moving upwards with the rotation of the concentration barrel until reaching a collecting area located above in the inner cavity of the concentration barrel;

enabling the selected minerals to fall into a first material receiving trough of the concentrating machine by use of a collecting mechanism in the collecting area, and leaving from the concentrating machine via the first material receiving trough, wherein the classifier is made of a magnetic conductive material.

2. The process according to claim 1, wherein a plurality of the classifiers are arranged at lower part of the inner cavity of the concentration barrel close to the barrel wall.

3. The process according to claim 1, wherein the selected mineral and other substance other than the selected mineral are fed to a dehydrator to perform a separation of water from mineral.

4. The process according to claim 1, wherein a second classifier parallel with the central axis of the concentration barrel is arranged at the upstream of the collecting mechanism in the collecting area.

5. The process according to claim 2, wherein each of the classifiers does not rotate with the concentration barrel.

6. The process according to claim 1, wherein before the ore pulp formed by mixing the mineral aggregates and the water entering into the concentrating machine, the mineral aggregates are ground; then the ground ore pulp is conveyed to a fineness sorter to perform fineness sorting, the mineral aggregates with unqualified fineness of a granular size larger than 0.180 mm are sent back to the grinder to be ground continuously, and the mineral aggregates with qualified fineness are conveyed to the concentrating machine.

7. The process of claim 2, wherein a second classifier parallel with the central axis of the concentration barrel is also arranged at the upstream of the collecting mechanism in the collecting area.

* * * * *